US007493878B2

(12) United States Patent
Schön et al.

(10) Patent No.: US 7,493,878 B2
(45) Date of Patent: Feb. 24, 2009

(54) DEVICE FOR VARIABLE ACTUATION OF THE GAS EXCHANGE VALVES OF INTERNAL COMBUSTION ENGINES

(75) Inventors: Helmut Schön, Frastanz (AU); Kai-Uwe Keller, Kreuzlingen (CH); Peter Kuhn, Weinheim (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 248 days.

(21) Appl. No.: 10/551,541

(22) PCT Filed: Mar. 17, 2004

(86) PCT No.: PCT/EP2004/002741

§ 371 (c)(1),
(2), (4) Date: Sep. 14, 2005

(87) PCT Pub. No.: WO2004/085803

PCT Pub. Date: Oct. 7, 2004

(65) Prior Publication Data

US 2007/0051329 A1 Mar. 8, 2007

(30) Foreign Application Priority Data

Mar. 24, 2003 (DE) ..... 103 12 961

(51) Int. Cl.
*F01L 1/34* (2006.01)

(52) U.S. Cl. ..... 123/90.16; 123/90.2; 123/90.39; 123/90.15; 74/569

(58) Field of Classification Search ..... 123/90.16, 123/90.2
See application file for complete search history.

(56) References Cited

U.S. PATENT DOCUMENTS

| | | | | |
|---|---|---|---|---|
| 6,481,399 | B1 * | 11/2002 | Morrn | 123/90.16 |
| 6,792,903 | B2 * | 9/2004 | Morrn | 123/90.16 |
| 6,907,852 | B2 * | 6/2005 | Schleusener et al. | 123/90.16 |
| 6,997,153 | B2 * | 2/2006 | Schon et al. | 123/90.44 |
| 7,296,546 | B2 * | 11/2007 | Schon et al. | 123/90.16 |
| 7,302,922 | B2 * | 12/2007 | Schon et al. | 123/90.16 |

* cited by examiner

*Primary Examiner*—Thomas Denion
*Assistant Examiner*—Kyle M Riddle
(74) *Attorney, Agent, or Firm*—Crowell & Moring LLP

(57) ABSTRACT

The invention relates to a device for the variable actuation of the gas exchange valves of internal combustion engines, whereby a continuously revolving cam drives an intermediate member which carries out an oscillating, pure rotational movement and moves a drive member in accordance with the respective valve lift curve via a control cam. In order to modify the valve lift curve, the position of the rotational axis of the intermediate member can be modified along an advance curve. The rotational axis of the intermediate member is represented by a pin which is freely rotatable at its guide end and which carries cam plates that are linked therewith in a rotationally fixed manner. Said cam plates define either directly or indirectly the respective required position on the advance curve. The pin is rotated via a suitable joining element.

20 Claims, 4 Drawing Sheets

DEVICE FOR VARIABLE ACTUATION OF THE GAS EXCHANGE VALVES OF INTERNAL COMBUSTION ENGINES

BACKGROUND OF THE INVENTION

The invention relates to a device for the variable actuation of the gas-exchange valves of internal combustion engines.

Such devices are used to configure the control the gas-exchanging valves, so that it is possible to operate reciprocating engines without the otherwise customary throttle valve.

Such a device is known, for example, from the DE 101 23 186 A1. For this device, a revolving cam initially drives an intermediate link, which carries out an oscillating, strictly rotational movement and carries a control cam, which is composed of a pause region and a lifting region. The control cam transfers the lifting cam, required for actuating the valve, to the roll of a cam follower-like power take-off element, which, in turn, actuates the valve. The desired, different valve-lifting cams are produced owing to the fact that the center of rotation of the intermediate link is shifted onto a circular path, which is concentric with the roll of the power take-off link in its position with the valve closed. The center of rotation is formed by a roll provided at the intermediate link, which is supported non-positively on a circular path in the housing, which is also concentric with the roll of the power take-off link, that is, forms a cam offset from the path of the center of rotation, and which is referred to as a gate. In addition, the roll mounted at the inter-mediate link, is supported at a radial cam, the angular position of which fixes the position of the center of rotation of its circular path.

Further devices of this type have become known, for which the center of rotation of the intermediate link, driven by the cam, is to be adjusted on a circular path (Offenlegungsschrift 195 32 334 A1; EP 0717 174 A1; DE 101 64 493). However, the prior publications do not teach the constructive realization of such an adjustment.

It is a common feature of all known devices that a separate adjusting device is required for adjusting the center of rotation of the intermediate link, driven by the cam. According to the state of the art, this adjusting device is constructed by an adjusting the cam shaft, which is mounted in the housing.

It is an object of the present invention to provide a device which, without a separate adjusting device, is constructed simply and with few components.

Preferably, the bolt, on which the intermediate link is mounted, is constructed simultaneously as an adjusting shaft For this purpose, it is provided with cam discs and is mounted freely rotatable or in hinged columns, in a four-bar mechanism or in a sliding element. The cam discs are fastened non-rotatably on the bolt. The cam discs are supported directly or indirectly at the housing. If the support is direct, sliding blocks of a material of greater strength may be provided in the housing for the cam discs. By rotating the adjusting shaft with a suitable adjusting agent, such as an adjusting motor, the desired valve lilting cam is set. Since the adjusting agent, such as an adjusting motor, usually is fastened to the housing, the bolt or control shaft, however, shifting during the adjusting motion parallel to itself, a connecting element must be disposed between the two, which permits this shifting. Depending on the space condition, this connecting element may be an articulated shaft, a Schmidt coupling, an Oldham coupling or also a gearwheel or chain gear mechanism. If the actuation is hydraulic, a lever mechanism is also available.

The inventive device, including an adjusting motor or an adjusting device, may be provided for all intake and exhaust valves of a cylinder head. If the intake and exhaust valves of a cylinder head are actuated by a common camshaft, the inventive device, including an adjusting motor or an adjusting device, may be provided for all intake and exhaust valves of a cylinder head. The inventive device, including its adjusting motor or an adjusting device may be provided separately for each valve of an engine, so that any combination of valve lifts or opening angles of the individual valves of an engine, including the switching off of individual cylinders, is possible. Usually, however, a common adjustment of several valves is provided. This is the case especially with multi-valve engines for the intake and exhaust valves of a cylinder. For example, two intake valves may be actuated by a cam over an intermediate link, which has a control cam for each valve. Since only one intermediate link and only one bolt are present, both valves are adjusted jointly and similarly. Pursuant to the invention, however, two different control valves may also be provided at the common intermediate link with the result that the two valves have different lifting cams, although they are adjusted jointly. Particularly in the lowest load range, this variation opens up the possibility of opening only one of the two valves. The special advantage of this possibility lies therein that, in the lowest load range, very small cross sections have to be opened up and this can be done more accurately, if they are opened up by only one valve. In addition, the possibility exists of producing a twist in the cylinder charge because only one of the intake valves is opened. The possibility of producing different valve lifting cams for two intake or also exhaust valves of a cylinder are expanded pursuant to the invention owing to the fact that two different cams and two different intermediate links with different control cams are used. Nevertheless, both valves can be adjusted jointly, since the two intermediate links may be mounted on a common bolt.

If required for structural reasons, such as the placement of the camshaft in a desired position, one or more additional gear mechanism elements may be disposed between the cam and the intermediate link.

It is furthermore possible to adjust the intermediate links of a larger number of parallel valves jointly by one adjusting motor or mechanism, especially if these are mounted on a common bolt.

For the acceptance of a variable valve control and therefore also of the inventive device, it is of great importance to keep the adjusting power low. Because this adjusting power is higher when the device or its slip joints and joints are under load than when they are in the force-free state, which is largely the case when the valve is closed, an adjustment essentially during the common pause phases of all valves, which are to be adjusted jointly, is provided pursuant to the invention. These phases are derived from the signal of the crankshaft and the camshaft and become shorter as the number of valves, which are to be adjusted jointly, increases. The number of such valves is therefore limited.

As a result of the joint adjustment of the intake and exhaust valves in each case of only one cylinder, there are long, adjustment-friendly pause phases. However, they also enable the load of the individual cylinders to be controlled individually with an inventive adjusting strategy in such a manner that, for each load state of the engine as a whole, the torques of the individual cylinders are controlled. This is essential especially if the engine is to run quietly in the lower load range, since, due to tolerances, the valve lifts normally are not sufficiently identical. The signals, required for this adjusting strategy, are also supplied by the angle of rotation transmitter of the crankshaft and assigned to the individual cylinders by the angle of rotation transmitter of the camshaft.

Pursuant to the invention, the advantage is achieved that a reliable adjusting device for gas-exchanging valves is created with simple components. Moreover, a sensitive adjustment is advantageous attained.

The invention is now explained in greater detail by means of drawings of some examples, in which

DESCRIPTION OF THE INVENTION

Figure 1:
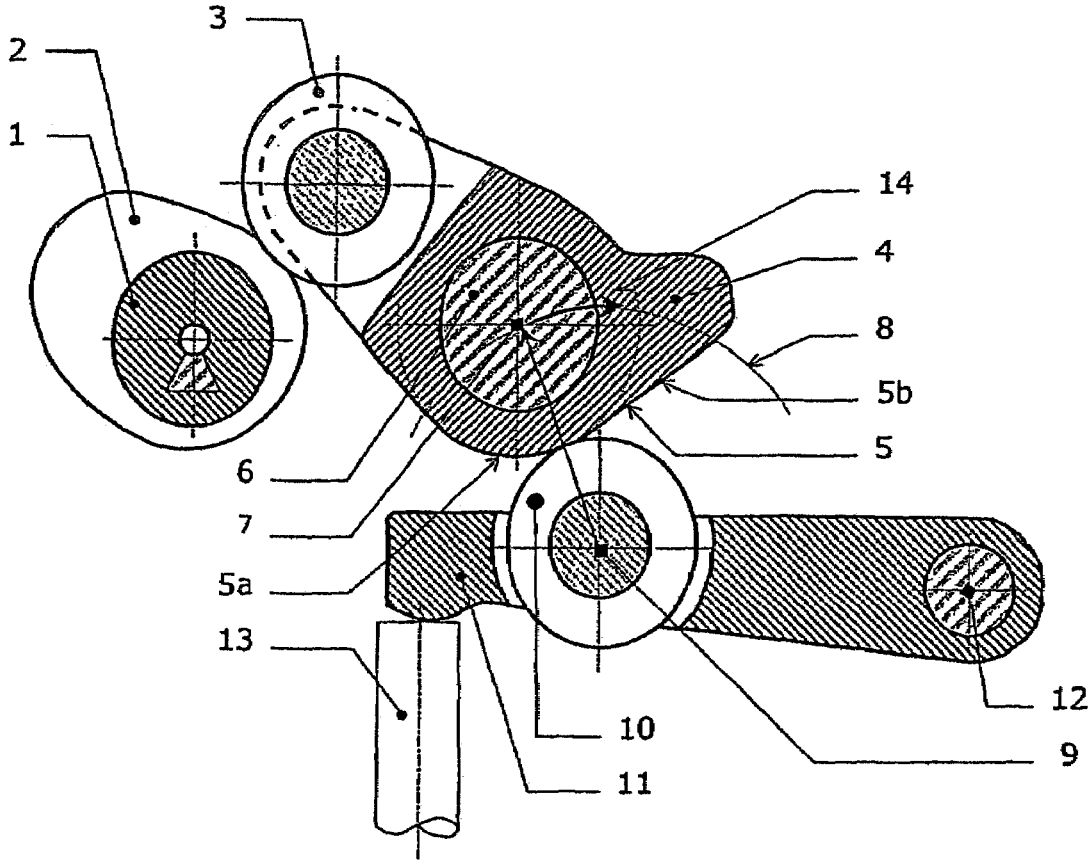
FIG. 1 shows the moving parts of the generic device, included in the flow of power from the camshaft to the valve.

FIG. 1 shows a camshaft 1, which carries a cam 2. This moves the roll 3 in the end region of the intermediate link 4. The roll 3 is fastened rotatably at the intermediate link 4, which has a one-part basic body. The intermediate link 4 has a control cam 5, which is composed of a pause region 5*a* and a lifting region 5*b*. The intermediate link 4 is mounted on a bolt 6, the axis 7 of which is guided on a circular adjusting cam 8. The center of the circular adjusting cam 8 lines on the axis 9 of the roll 10 of the power take-off element 11, which is supported over a joint 12 in the housing, which is not shown, and actuates the valve 13. It can be seen clearly that an adjustment of the axis 7 and of the adjusting cam 8 in the direction of arrow 14 results in a decrease in the opening angle and in the lift of the valve 13.

Figure 2A:
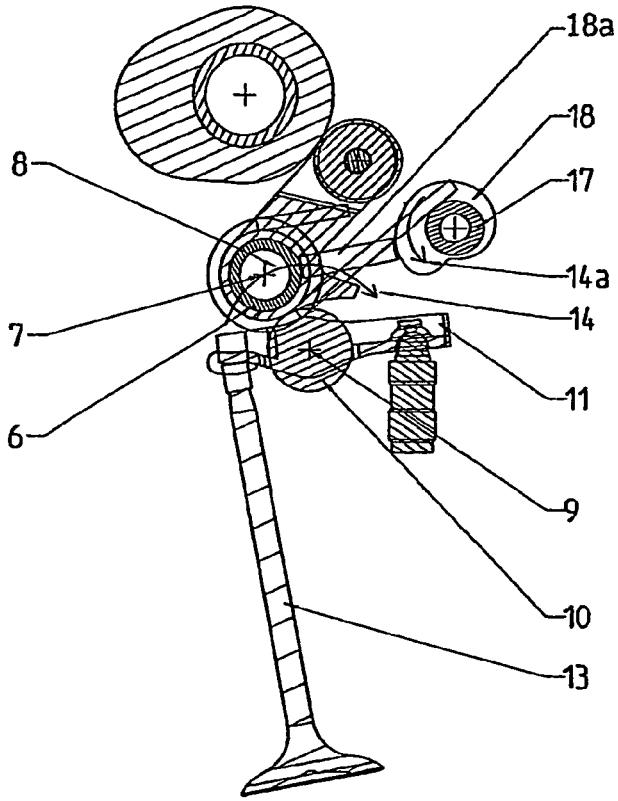
FIG. 2 shows a cross-section, using the parts with hinged columns and adjusting shaft, shown in FIG. 1.
Figure 2B:
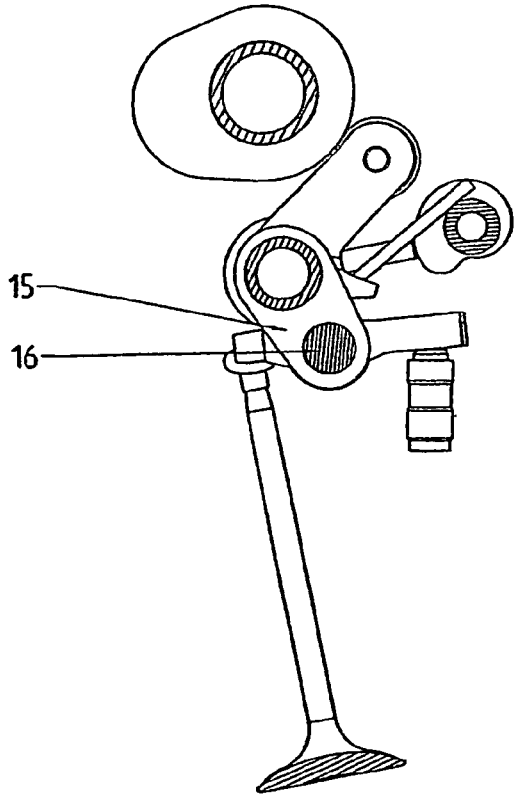

FIG. 2 shows an embodiment, for which the bolt 6 or its axis 7 is guided non-positively by hinged columns 15 on the circular adjusting cam 8. The joint 16 of the hinged columns 15 or its axis on the cylinder head side coincides with the axis 9 of the roll 10 of the power-takeoff element 11. The adjusting shaft 17 carries cam disks 18, which fix the position of the bolt 6 or its axis 7 over tappets 18*a* on the adjusting cam 8. An adjustment of the axis 7 on the adjusting cam 8, as indicated by the directional arrow 14, is brought about by twisting the cam disk 18 or the adjusting shaft 17 as indicated by to the directional arrow 14*a*. The adjusting movement described results in a decrease in the lifting and opening angle of the valve 13. If permitted by the structural boundary conditions, such as the available space, it is also possible to do without the tappet 18*a*. In this case, the cam disks 18 can act directly on the bolt 6.

Figure 3:
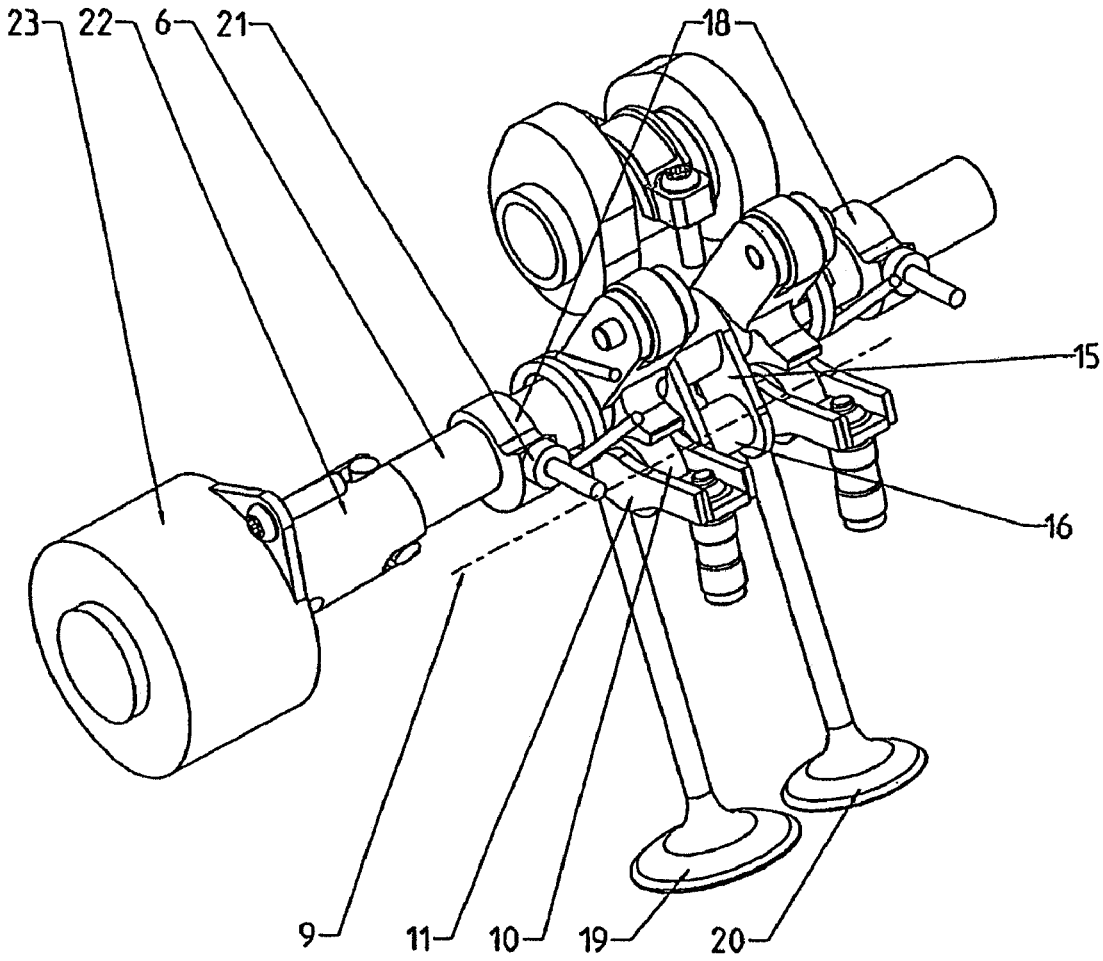
FIG. 3 shows a perspective representation of the inventive device with hinged columns and the bolt as adjusting shaft and FIG. 4 diagrammatically shows the interaction of the engine management, gas pedal, angle of rotation transmitter, adjusting motor and battery.

FIG. 3 shows a perspective representation of the inventive device with hinged columns 15 for the intake valve 19 and the exhaust valve 20 of a cylinder, taken from a series of cylinders and valves. The joint 16 of the hinged columns 15 at the cylinder head side, the axis of which coincides with the axis 9 of the roll 10 of the power-take off elements 11, can be seen clearly, so that the bolt 6 is guided forcibly on a circular adjustment cam. In distinction from the embodiment of FIG. 2, the bolt 6, pursuant to the invention, simultaneously assumes the function of the adjusting shaft. It carries the cam discs 18, which are supported on hardened sliding blocks 21 in the housing and can be rotated in the hinged columns. The bolt 6 is connected over a suitable connecting element with the adjusting motor 23, which is fastened to the housing. In the present example, the connecting element is an articulated shaft 22. This embodiment offers appreciable advantages with respect to parts diversity, but also with respect to the available space in the region of the actual valve control. There is some flexibility for accommodating the adjusting motor 23, since, in addition to articulated shafts, other connecting elements, such as Schmitt couplings, Oldham couplings and gearwheel or chain gear mechanisms also come into consideration.

Figure 4:
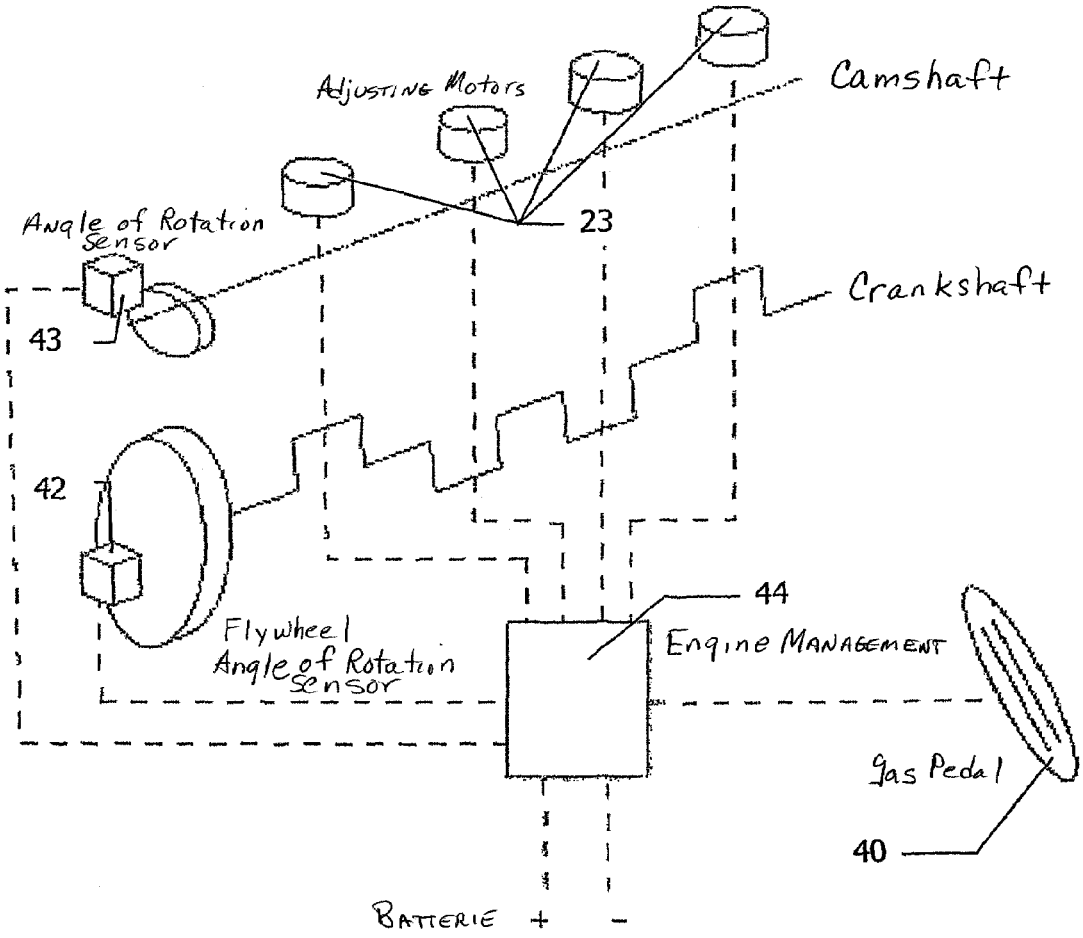

FIG. 4 diagrammatically shows the interaction of the gas pedal 40, the adjusting motors 23, the angle of rotation sensor 42 at the flywheel and the angle of rotation sensor 43 at the camshaft with the engine management 44. A signal, emitted by the gas pedal 40 or a sensor for its position, is converted by the engine management 44 into a signal at the adjusting motors 23 for increasing or decreasing the valve lifts. When the desired load condition for the whole of the engine is reached, the engine management 44 evaluates the signals of the high resolution angle of rotation sensor 42 at the flywheel. With the help of the angle of rotation sensor 43 of the low resolution at the camshaft or at a different shaft running at half the rpm of the crankshaft, these signals are assigned to the individual cylinders. With this information, signals go to the individual adjusting motors 23 for leveling the torque peaks or the crankshaft rpm, in that the valve lifts of the cylinders with smaller torques are corrected upward and those of the cylinders with larger torques are corrected downward. Pursuant to the invention, an adjustment, with or without equalization, takes place during common pause phases of the valves operated by one adjusting motor. Moreover, motor management 44 infers the phase position of the valves from the sensor 43 at the camshaft.

LIST OF REFERENCE SYMBOLS

1 camshaft
2 cam
3 roll
4 intermediate link
5 control cam
5*a* pause region
5*b* lifting region
6 bolt
7 axis
8 adjusting cam
9 axis
10 roll
11 power take-off element
12 joint
13 valve
14 arrow
14*a* directional arrow
15 hinged columns
16 joint
17 adjusting shaft
18 cam disk
18*a* tappet
19 intake valve
20 exhaust valve
21 sliding block
22 articulated shaft
23 adjusting motor
40 gas pedal
42 angle of rotation sensor
43 angle of rotation sensor
44 engine management

The invention claimed is:

1. A device for variable actuation of gas exchange valves of an internal combustion engine having rotational speed, comprising: a camshaft with at least one cam mounted in a housing and rotating independently of said rotational speed of said engine; an intermediate link driven initially by said cam and carrying out an oscillating rotational movement about an axis of rotation in said housing; an adjusting cam having a control cam with a pause region and a lifting region, said axis of rotation being shiftable parallel to itself along said adjusting cam; a power take-off element actuated by said control cam and actuating at least one of said gas-exchange valves; said intermediate link being mounted on a bolt with an axis corresponding to said axis of rotation of said intermediate link, said bolt being mounted parallel displaceably on said adjusting cam with parallel displacement; cam discs and tappets supported against said housing and producing said parallel displacement; an adjusting shaft mounting rotatably with said cam discs at said housing, said cam discs producing an adjusting movement transferred over said tappets onto said bolt.

2. A device as defined in claim 1, wherein said cam discs support said bolt in a substantially tangential direction with respect to said adjusting cam.

3. A device as defined in claim 1, including a hydraulic clearance equalizing element at said power take-off element.

4. A device as defined in claim 1, wherein each said valve is arranged separately.

5. A device as defined in claim 1, including a separate arrangement of intake and exhaust valves of a cylinder head.

6. A device as defined in claim 1, including a separate arrangement for all valves of a cylinder head.

7. A device as defined in claim 1, including a separate arrangement for each of two adjacent parallel valves of a cylinder.

8. A device as defined in claim 7, including a common combined actuation of intake and exhaust valves of a cylinder.

9. A device as defined in claim 8, including a common intermediate link with two identical control cans for two valves.

10. A device as defined in claim 8, including a common intermediate link with two different control cams for the two valves.

11. A device as defined in claim 7, including two identical cams and two intermediate links with identical control cams for two valves.

12. A device as defined in claim 7, including two different cams and two intermediate links with different control cams for two valves.

13. A device as defined in claim 7, including two different cams and two intermediate links with identical control cams for two valves.

14. A device as defined in claim 1, including an adjustment for keeping at least one valve closed constantly.

15. A device as defined in claim 1, including a hydraulic unit specifying respective requested angular position to said bolt.

16. A device as defined in claim 1, including an electric adjusting motor specifying a requested angular position to said bolt over gear means.

17. A device as defined in claim 1, including a rotation transmitter with a crankshaft angle signal, valve lifts of individual cylinders being adjusted constantly as a function of said angle signal.

18. A device as defined in claim 1, including an adjusting motor operating jointly adjusting movements during a joint pause phase of all valves.

19. A device for variable actuation of gas exchange valves of an internal combustion engine having rotational speed, comprising; a camshaft with at least one cam mounted in a housing and rotating independently of said rotational speed of said engine; an intermediate link driven initially by said cam and carrying out an oscillating rotational movement about an axis of rotation in said housing; an adjusting cam having a control cam with a pause region and a lifting region, said axis of rotation being shiftable parallel to itself along said adjusing cam; a power take-off element actuated by said control cam and actuating at least one of said gas-exchange valves; said intermediate link being mounted on a bolt, with an axis corresponding to said axis of rotation of said intermediate link, said bolt being mounted parallel displaceably on said adjusting cam with parallel displacement; cam dics and tappets supported against said housing and producing said parallel displacement; said bolt being mounted rotationally movably in guides of said bolt and carrying at least one of said cam discs supported with their cams at said housing, said bolt being twistable over a connecting element by an adjusting agent.

20. A device as defined in claim 19, including sliding blocks in said housing with material of greater hardness than against which said cam dics are supported.

* * * * *